DAMPER ASSEMBLY FOR USE WITH AN AIR CONDITIONING SYSTEM

BACKGROUND OF THE INVENTION

1. Field of the Invention

This invention relates in general to a damper assembly for diverting a flow of gaseous medium. More specifically, this invention relates to a damper assembly including a flexible leaf spring for securing the damper in various positions, said damper regulating the flow of conditioned air to various outlets.

2. Prior Art

Air conditioning units which are commonly used for light commercial applications such as hotels, dormitories and office buildings often are of the type known as a packaged terminal air conditioning unit. These packaged terminal air conditioners extend through the wall of the enclosure and normally have a condensing section located for discharging heat energy to the ambient sink of the atmosphere and an evaporator section located within the enclosure wherein air in the enclosure may be conditioned.

These units are usually spaced along an exterior wall of the enclosure to be conditioned located within a specific sub-enclosure therein. Oftentimes it is desirable to treat the air in more than one sub-enclosure utilizing a single packaged terminal air conditioning unit. To accomplish this, an adapter has been developed which may be inserted into the normal air discharge flow path of the packaged terminal air conditioning unit. This adapter has a damper assembly for directing a portion of the conditioned air into the room or sub-enclosure containing the packaged terminal air conditioning unit and for directing a portion of the conditioned air through an outlet in the adapter to a duct assembly for discharging that air into a separate sub-enclosure.

The damper assembly hereinafter described is suitable for use in an adapter to regulate the flow of air being discharged from the unit to the various sub-enclosures. This damper assembly has other applications to various air flow situations wherein it is desirable to either limit the flow of air through a particular duct or to divert that flow between various outlets.

SUMMARY OF THE INVENTION

An object of the present invention is to provide a damper assembly for regulating the flow of air.

It is a further object of the present invention to provide a pivotally mounted damper which may be positioned by contact with a flexible spring.

It is another object of the present invention to provide a combination flexible spring and damper assembly for regulating air flow through a housing.

It is another object of the present invention to provide a safe, economical, reliable and easy to manufacture damper assembly which may be utilized in numerous applications.

Other objects will be apparent from the description to follow and the appended claims.

In accordance with the preferred embodiment of the invention, the above objects are achieved by the provision of housing defining an air flow path. The housing has walls which define both an inlet and at least one outlet. The damper is pivotally mounted to control air flow to the outlet. A flexible spring is secured to extend between two walls of the housing. The spring is assembled under tension such that it is bowed in an arcuate configuration similar to the path of rotation of the edge of the damper. The configuration allows the edge of the damper to constantly maintain a frictional contact with the spring. Hence when the damper is rotated to a selected position, the frictional force provided by the spring against the damper acts to secure the damper in that position. A bracket for securing one end of the spring and a wall junction for securing the other end of the spring are additionally disclosed.

DESCRIPTION OF THE PREFERRED EMBODIMENT

The embodiment hereafter described will be detailed in reference to a specific application with a packaged terminal air conditioning unit. It is to be understood that this damper assembly has like applicability to all types of air conditioning units and in general to the regulation of an air flow stream through a housing. The application of this damper assembly is not limited to air conditioning units or even to air as the gaseous media flowing therethrough.

Additionally as described herein, the damper assembly will act to divert air between one of two outlets from the housing. Dampers of this nature may also be used to simply regulate the volume of air flow through a single outlet. The description of the herein invention in reference to an embodiment regulating flow between two outlets is not intended to limit this application.

Figure 1:
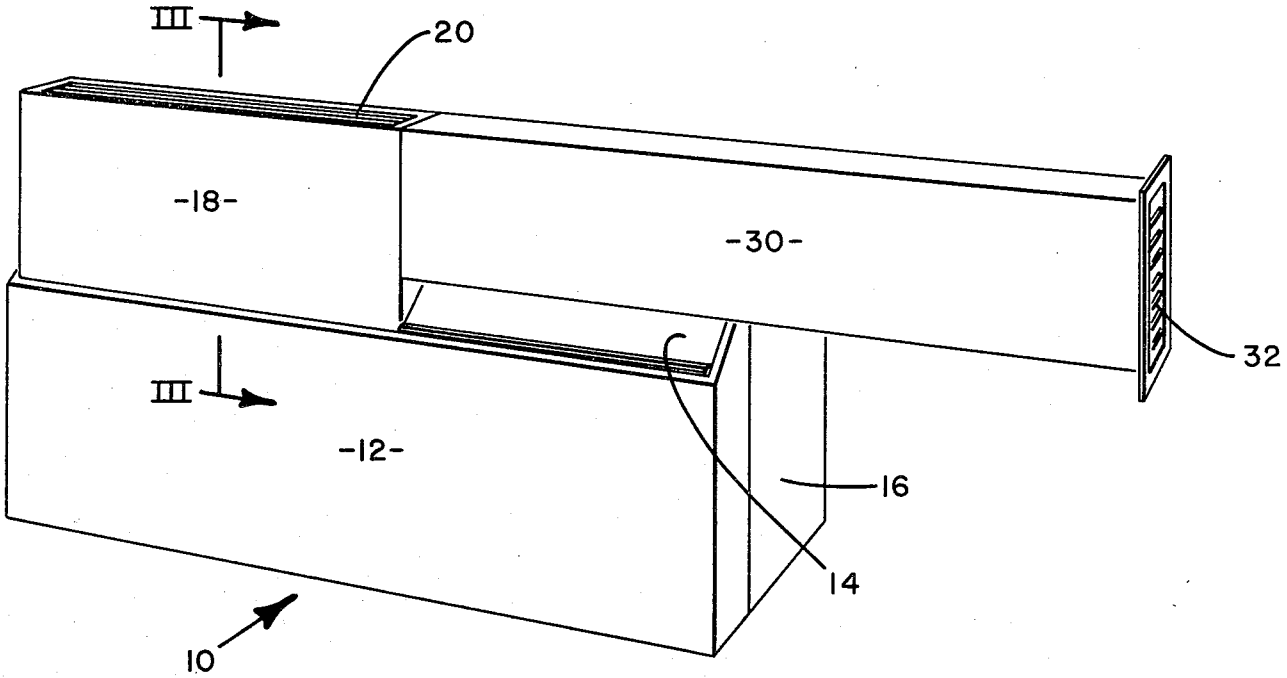
FIG. 1 is an isometric view of a packaged terminal air conditioning unit having an adapter and a duct extension such that conditioned air may be discharged from two outlets.

Referring now to the drawings, there may be seen in FIG. 1, a packaged terminal air conditioning unit having an adapter and a duct extension for use in supplying conditioned air to multiple sub-enclosures. An air conditioning unit 10 is shown having a front cover 12, side wall 16 and control door 14. The control door is mounted to cover the controls for regulating the operation of the unit.

Although not shown, adapter 18 is inserted into the air discharge opening of the unit when it is desired to provide conditioned air for more than one enclosure from a single unit. As shown in FIG. 1, the adapter is mounted to the unit and discharge grille 20 is mounted at the top of the adapter such that a portion of the air discharged from unit 10 is discharged through grille 20. Duct extension 30 is mounted at the end of adapter 18 and has register 32 mounted at the end of the duct extension. When assembled, register 30 will normally be in an adjacent sub-enclosure such that conditioned air may be discharged from discharge grille 20 into one sub-enclosure and from register 32 into a separate sub-enclosure.

Figure 2:
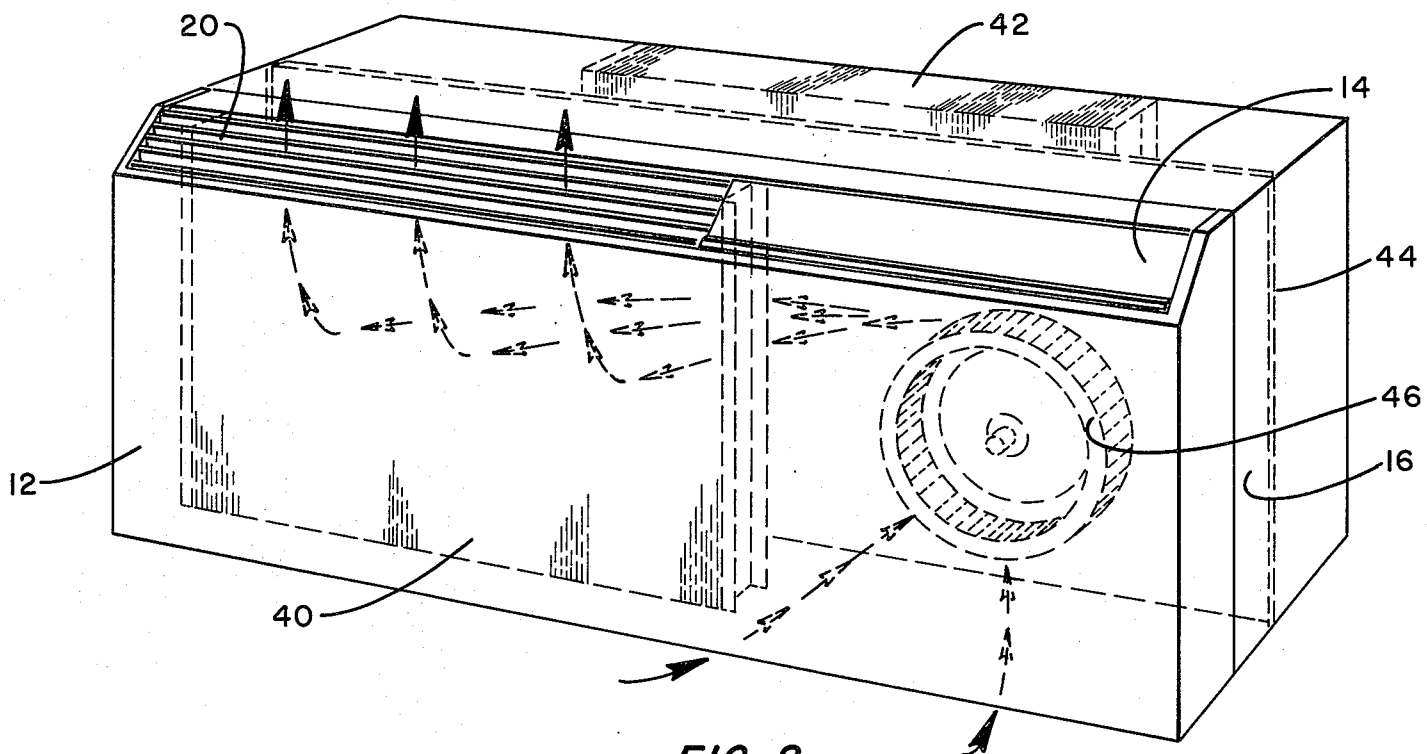
FIG. 2 is a partially cut-away isometric view of a packaged terminal air conditioning unit showing the internal air flow path.
Figure 3:
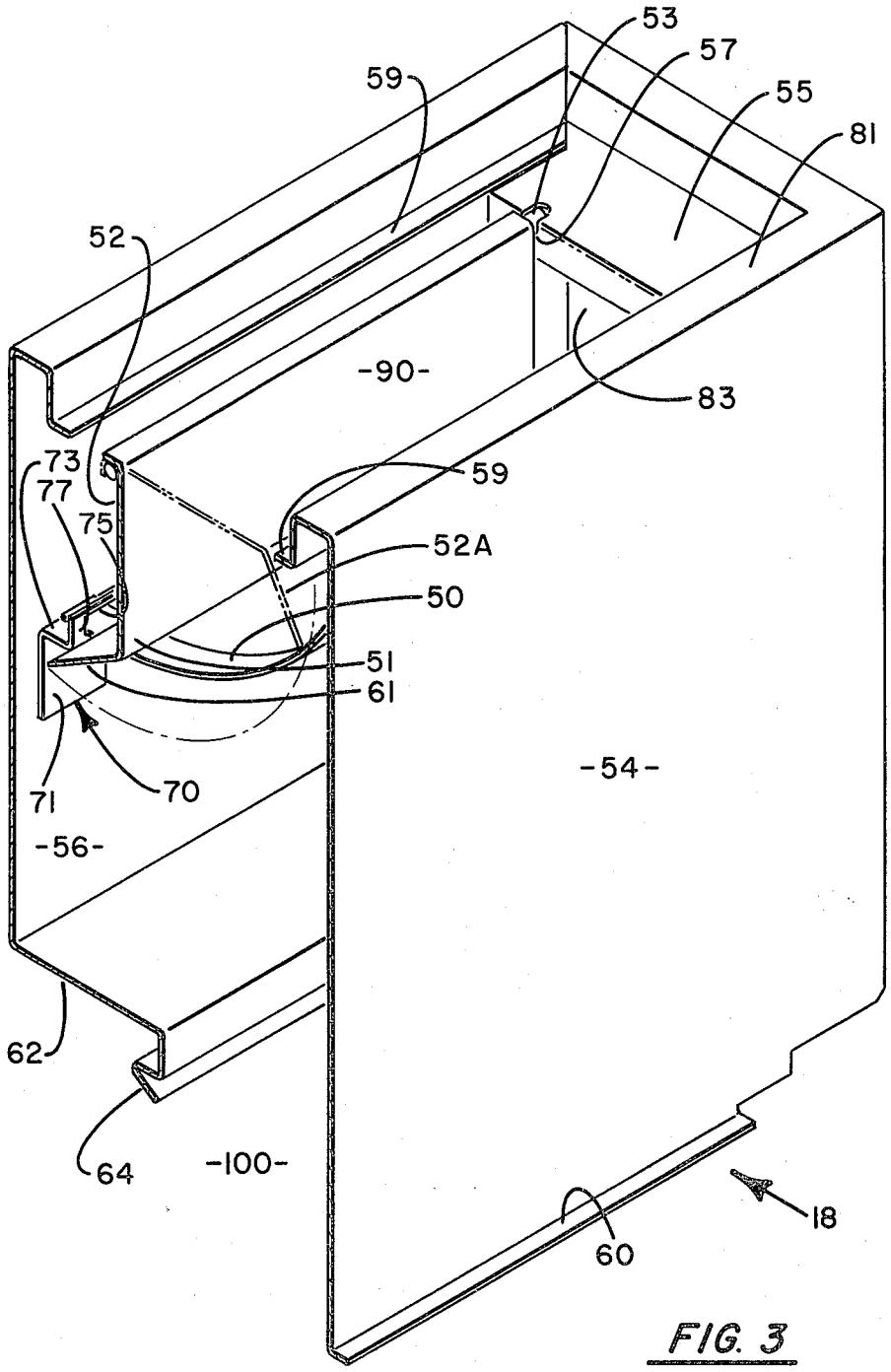
FIG. 3 is an end view of the adapter taken along line III—III as shown in FIG. 1.
Figure 4:
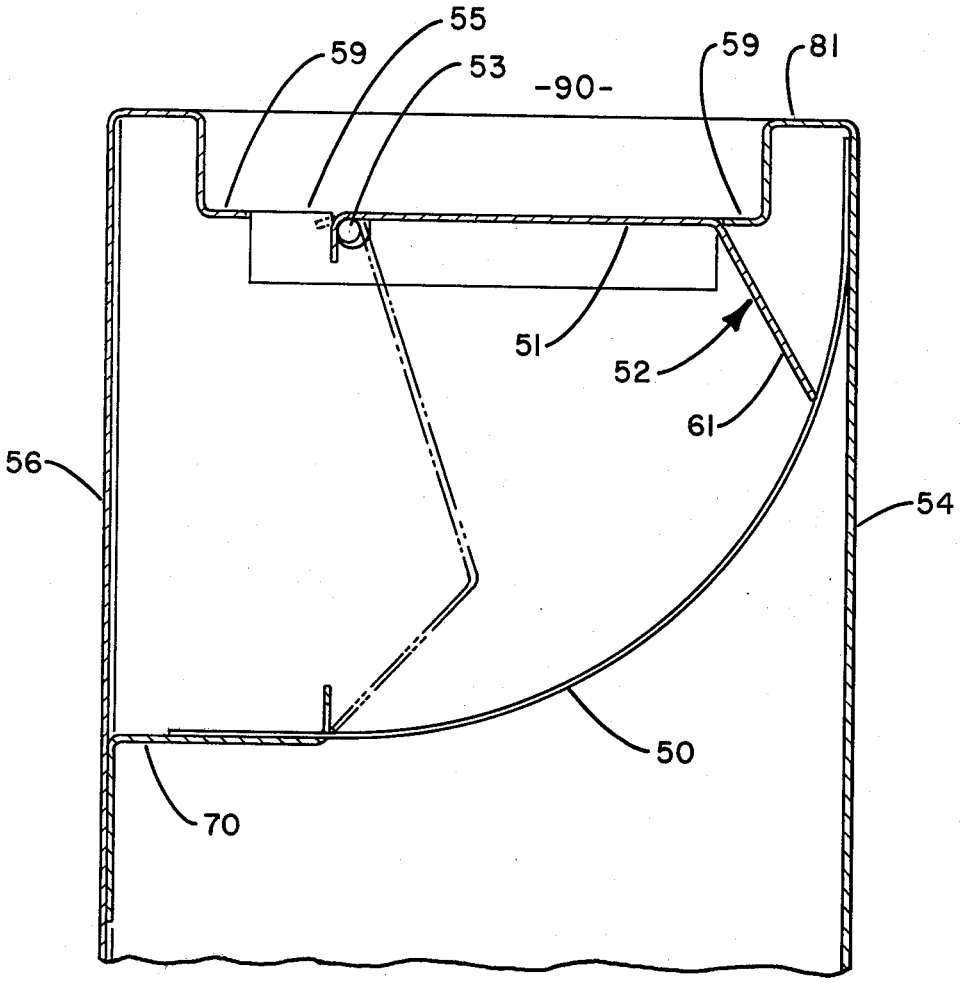
FIG. 4 is a sectional view of that portion of the adapter having the damper assembly.

FIG. 2 shows the internal components of packaged terminal air conditioning unit 10 such that the internal air flow thereof may be seen. Discharge grille 20 is shown mounted in FIG. 2 above and forward of the a housing having an inlet and at least one outlet, said device defining a medium flow path from the inlet to the outlet;

a pivotally mounted damper located to obstruct the medium flow path, said damper being rotated between various positions to effect differing impediments to medium flow along said path; and means for securing the damper in a preselected position including a flexible leaf spring mounted to frictionally engage the damper such that an edge of the damper contacts the spring to maintain the damper in position, said leaf spring being frictionally engaged at both ends in an arcuate configuration such that an edge of the damper contacts the spring continually as the damper is rotated between positions.

2. The apparatus as set forth in claim 1 wherein the damper is mounted to regulate medium flow through the outlet of the housing, said damper having a damper body portion for blocking the housing outlet and a damper extension portion angled from the damper body portion, said damper extension portion contacting the flexible spring.

3. The apparatus as set forth in claim 1 wherein the housing has a first wall and a second wall angled therefrom forming a junction, a third wall spaced from the first and wherein the means for securing the damper includes mounting means affixed to the third wall for slidably engaging an end portion of the spring, the opposite end of said spring being secured within the interior angle of the junction formed by the first and second walls.

4. The apparatus as set forth in claim 3 wherein the mounting means includes a bracket having a support spaced from the third wall, said support defining a slot through which the spring is inserted and means for affixing the support to the third wall.

5. The apparatus as set forth in claim 1 wherein the housing has a second outlet, said damper acting to impede the medium flow path to the first outlet to direct a portion of said medium along a second flow path to the second outlet.

6. Apparatus associated with an air conditioning system for directing a stream of conditioned air which comprises:

a housing having an inlet for receiving conditioned air, a first outlet for discharging conditioned air, and a second outlet for discharging conditioned air;

a damper mounted for pivotal rotation relative to the housing, said damper being located between the inlet and first outlet of the housing such that the damper may be positioned to impede conditioned air flow to the first outlet thereby diverting conditioned air flow to the second outlet; and means for securing the damper in a selected position, said means including a flexible leaf spring mounted along the path of rotation of the damper edge, said leaf spring being frictionally engaged at both ends in an arcuate configuration such that the spring frictionally engages the edge of the damper continuously along said path of rotation to secure the damper in a selected position.

7. The apparatus as set forth in claim 6 wherein the air flow resistance to conditioned air being discharged from the first outlet is less than the air flow resistance to conditioned air being discharged through the second outlet whereby upon the damper being placed in a position not to impede air flow to the first outlet conditioned air flow from the housing will primarily be through the first outlet and only upon said damper being positioned to impede air flow to the first outlet will significant conditioned air flow be discharged from the second outlet.

8. The apparatus as set forth in claim 7 wherein the housing has a first wall which forms a junction with a second wall and a third wall spaced from the first wall; wherein the means for securing the damper includes a bracket mounted to the third wall said bracket having a support defining a slot for securing one end of the spring; and wherein the other end of the spring is secured in the interior space between the junction of the first wall and the second wall, the spring having a length longer than the distance between the slot in the support and the junction whereby the spring is flexed upon assembly such that the tension in the spring acts to secure the spring between the support and the junction and serves to bow the spring into an arcuate configuration similar to the path of rotation of the edge of the damper.

9. The apparatus as set forth in claim 8 wherein the damper has a damper body portion and a damper extension portion, the damper body serving to impede air flow and the damper extension formed at an angle to the damper body having an edge contacting the spring to secure the damper in position.

* * * * *

United States Patent [19]

Adams et al.

[11] 4,316,409

[45] Feb. 23, 1982

[54] CARBONATED BEVERAGE CONTAINER

[75] Inventors: Joan M. Adams, Fairview; Myron B. Shoaf, Cranbury, both of N.J.; Carl E. Bochmann, Cleveland; Peter A. Basile, Hudson, both of Ohio

[73] Assignee: General Foods Corporation, White Plains, N.Y.

[21] Appl. No.: 83,737

[22] Filed: Oct. 10, 1979

[51] Int. Cl.[3] ..... A23L 2/40

[52] U.S. Cl. ..... 99/275; 261/DIG. 7; 426/561

[58] Field of Search ..... 99/275, 323, 323.1, 99/323.2; 426/561, 78, 591, 477; 261/DIG. 7, 121 R, 133, 18 R; 220/1 E; 366/130

[56] References Cited

U.S. PATENT DOCUMENTS

| | | | |
|---|---|---|---|
| 2,073,273 | 3/1937 | Wetstein | 99/323.1 |
| 2,591,990 | 4/1952 | Wisdom | 261/DIG. 7 |
| 2,805,846 | 9/1957 | Dewan | 261/DIG. 7 |
| 3,492,671 | 1/1970 | Hovey | 99/323.1 |
| 4,003,555 | 1/1977 | Swartz | 220/1 E |
| 4,186,215 | 1/1980 | Buchel | 99/323.1 |

FOREIGN PATENT DOCUMENTS

| | | | |
|---|---|---|---|
| 101048 | 5/1937 | Australia | 99/323.1 |

*Primary Examiner*—Robert W. Jenkins

*Attorney, Agent, or Firm*—Daniel J. Donovan; Bruno P. Struzzi

[57] ABSTRACT

A closed pressurized container for producing a carbonated beverage of superior quality by providing for contact therein of water and a solid carbonation source. The pressurized container is designed to withstand the pressures and temperatures generated during the preparation of a carbonated beverage from a solid carbonation source. In a preferred embodiment, the container is a rigid receptacle in the shape of a wide mouth bottle adapted to receive a large cap or cover. A perforated basket is mounted inside the cover, and is accessible to water in the bottle when that vessel is turned upside down to an inverted position. A spring loaded, manually operated valve is provided in the cover to permit venting of carbon dioxide from the interior thereof after the water-based mixture within the container has become sufficiently carbonated by absorbing carbon dioxide released by contact of water with the solid carbonation source.

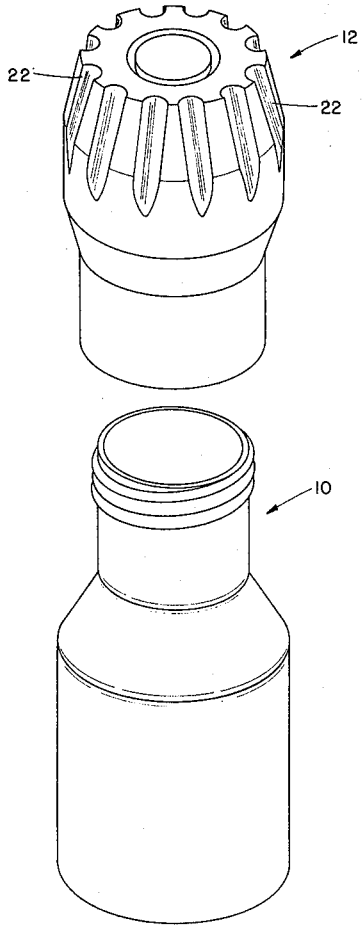

13 Claims, 9 Drawing Figures